US009948048B2

(12) United States Patent
Ng et al.

(10) Patent No.: US 9,948,048 B2
(45) Date of Patent: Apr. 17, 2018

(54) SPLITTER TERMINAL AND CONNECTOR

(71) Applicant: Yazaki North America, Inc., Canton, MI (US)

(72) Inventors: Jen Vun Ng, Westland, MI (US); Eiji Aoki, Plymouth, MI (US); Hee Jin Bang, Ann Arbor, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 15/146,611

(22) Filed: May 4, 2016

(65) Prior Publication Data

US 2016/0336703 A1 Nov. 17, 2016

Related U.S. Application Data

(60) Provisional application No. 62/162,356, filed on May 15, 2015.

(51) Int. Cl.

| | |
|---|---|
| ***H01R 24/38*** | (2011.01) |
| ***H01R 31/02*** | (2006.01) |
| ***H01R 13/426*** | (2006.01) |
| ***H01R 13/04*** | (2006.01) |
| ***H01R 13/10*** | (2006.01) |
| *H01R 13/422* | (2006.01) |

(52) U.S. Cl.

CPC ..... *H01R 31/02* (2013.01); *H01R 13/04* (2013.01); *H01R 13/10* (2013.01); *H01R 13/426* (2013.01); *H01R 13/4223* (2013.01)

(58) Field of Classification Search

CPC ..... H01R 4/24; H01R 31/02

USPC ..... 439/439, 441, 907, 595, 723, 724

See application file for complete search history.

(56) References Cited

U.S. PATENT DOCUMENTS

| | | | | |
|---|---|---|---|---|
| 2,457,703 | A * | 12/1948 | Merkel | H01R 13/26 439/50 |
| 2,703,395 | A * | 3/1955 | Long | H01R 31/00 439/723 |
| 3,263,202 | A * | 7/1966 | Dean | H01R 31/02 439/724 |

(Continued)

FOREIGN PATENT DOCUMENTS

| | | |
|---|---|---|
| DE | 12 18 577 B | 6/1966 |
| DE | 9302131 U1 | 4/1993 |

(Continued)

OTHER PUBLICATIONS

Extended European Search Report from EP Application No. 16169542 dated Sep. 22, 2016.

(Continued)

*Primary Examiner* — Neil Abrams
(74) *Attorney, Agent, or Firm* — Foley & Lardner LLP

(57) ABSTRACT

A connector assembly may include first and second connector bodies and a terminal splitter. The second connector body may matingly engage the first connector body. The terminal splitter may be received in at least one of the first and second connector bodies. The terminal splitter may include a body portion having first and second wires connected thereto and a blade portion extending from the body portion and including a third wire connected thereto. The third wire may be joined to a female receptacle mounted in the other one of the connector bodies for being joined to the blade portion.

13 Claims, 7 Drawing Sheets

(56) References Cited

U.S. PATENT DOCUMENTS 3,264,599 A * 8/1966 Kinkaid ..... H01R 12/724 439/374
3,432,788 A * 3/1969 Startin ..... H01H 85/202 257/E27.028
3,853,388 A * 12/1974 Heimbrock ..... H01R 13/567 439/685
4,174,878 A * 11/1979 Debaigt ..... H01R 13/115 439/724
4,682,840 A * 7/1987 Lockard ..... H01R 24/30 29/860
4,701,000 A * 10/1987 Suprono ..... H01R 4/4818 439/423
4,767,357 A * 8/1988 Hasircoglu ..... H01R 23/667 439/499
4,902,092 A * 2/1990 Grandy ..... G02B 6/3807 385/101
5,035,657 A * 7/1991 Hass ..... H01R 25/00 439/596
5,071,370 A * 12/1991 Kochan, Jr. ..... H01R 29/00 439/52
5,145,417 A * 9/1992 Honkomp ..... H01R 13/68 439/502
5,435,117 A * 7/1995 Eggena ..... A01D 34/27 56/10.2 D
5,645,455 A * 7/1997 Seki ..... H01R 13/405 439/189
5,711,686 A * 1/1998 O'Sullivan ..... H01R 9/038 29/879
6,257,938 B1 * 7/2001 Day ..... H01R 13/6272 439/721
6,364,701 B1 * 4/2002 O'Sullivan ..... H01R 9/038 439/497
6,570,306 B2 * 5/2003 Henrici ..... H01R 4/4818 313/318.01
6,739,920 B2 * 5/2004 Fujii ..... H01R 31/085 439/723
6,905,346 B2 * 6/2005 Momota ..... H01R 9/226 361/833
7,438,605 B1 * 10/2008 Huang ..... H01R 4/28 174/92
7,527,509 B1 * 5/2009 Bethurum ..... H01R 4/4818 439/153
7,766,673 B1 * 8/2010 Dumont ..... H01R 13/68 439/76.2
8,100,725 B2 * 1/2012 Su ..... H01R 27/00 439/660
8,303,349 B2 * 11/2012 Shmukler ..... H01R 13/2435 439/724
8,337,251 B2 * 12/2012 Ecker ..... H01H 85/044 439/620.27
8,563,862 B2 * 10/2013 Mochizuki ..... H01R 4/26 174/68.2
8,579,650 B2 * 11/2013 Keswani ..... H01R 4/4818 439/441
8,708,735 B2 4/2014 Aime et al.
8,794,995 B2 * 8/2014 Wu ..... H01R 12/598 439/497
9,118,121 B2 * 8/2015 Yamamoto ..... H01R 4/18
9,130,285 B2 * 9/2015 Scanzillo ..... H01R 4/4818
9,308,364 B2 * 4/2016 McDonald ..... A61N 1/0551
9,431,760 B2 * 8/2016 Itou ..... H01R 13/6271
9,653,859 B1 * 5/2017 Moore ..... H01R 24/38
9,691,580 B2 * 6/2017 von zur Muehlen ..... H01H 85/203
2009/0088028 A1 4/2009 Ngo et al.
2009/0104803 A1 4/2009 Bethurum et al.
2012/0032298 A1 2/2012 Miyagawa et al.
2014/0045387 A1 2/2014 Furuya et al.
2016/0336703 A1 * 11/2016 Ng ..... H01R 31/02

FOREIGN PATENT DOCUMENTS

DE 4433983 A1 3/1996
EP 1124287 A1 8/2001
JP 4387055 B2 12/2009
JP 2014207070 A 10/2014
WO 201101318 A1 1/2011

OTHER PUBLICATIONS

Office Action in Japanese Application No. 201609779 dated Mar. 28, 2017. Translation provided by Harakenzo World Patent & Trademark Intellectual Property Law Firm.

* cited by examiner

SPLITTER TERMINAL AND CONNECTOR

CROSS-REFERENCE TO RELATED APPLICATIONS

This application claims the benefit of U.S. Provisional Application No. 62/162,356, filed on May 15, 2015. The entire disclosure of the above application is incorporated herein by reference.

FIELD

The present disclosure relates to a splitter terminal and connector assembly including the splitter terminal.

BACKGROUND AND SUMMARY

This section provides background information related to the present disclosure and is not necessarily prior art. This section also provides a general summary of the disclosure, and is not a comprehensive disclosure of its full scope or all of its features.

An electrical connector assembly can include one or more wire pairs, each including a single male terminal crimped onto a single wire and mated with a single female terminal crimped onto another single wire. Such a configuration results in a relatively large connector assembly and relatively high insertion forces, especially when the assembly includes a plurality of such wire pairs. For example, where an assembly includes four electrical circuits, the assembly may include four male-female terminal pairs and eight wire harnesses. The connector insertion force for such an assembly will be quite high to properly insert the four male terminals into the four female terminals. Further, the overall size of the connector assembly will need to be large enough to house all four terminal pairs.

In one form, the present disclosure provides a splitter terminal that allows for at least three separate wires to be electrically connected thereto. Two of the wires may be welded to the splitter terminal, and a male blade of the terminal can be accepted by a female spring terminal attached to the third wire. The terminal allows for current flow from one welded connection to another welded connection and to the third wire through the blade and female spring terminal. The shape and structure of the terminal makes the connector mating force lower than some conventional connectors and can be packaged in a smaller space. The splitter terminal allows for fewer terminal connections, which can lower the insertion force necessary to fully electrically connect the assembly.

In another form, the present disclosure provides a connector assembly that may include a first connector body, a second connector body and a terminal splitter. The second connector body may be configured to matingly receive the first connector body. The terminal splitter may be received in the first and second connector bodies. The terminal splitter may include a body portion having first and second wires connected thereto and a blade portion extending from the body portion and having a third wire connected thereto.

In some configurations, the body portion includes an aperture that at least partially receives a flexible tab of the first connector body.

In some configurations, the flexible tab includes a ramped surface and a stop surface. A portion of the ramped surface and a portion of the stop surface may be received in the aperture. The stop surface may interfere with a surface defining the aperture to restrict removal of the terminal splitter from the first and second connector bodies.

In some configurations, the terminal splitter is a metallic member formed as a unitary body.

In some configurations, a width of the body portion is at least two times greater than a width of the blade portion.

In some configurations, a longitudinal axis of the blade portion extends through the aperture.

In some configurations, the surface of the aperture with which the stop surface interferes is a flat surface extending perpendicular to the longitudinal axis of the blade portion.

In some configurations, the blade portion includes a tapered distal end.

In some configurations, the third wire includes a female receptacle that receives the blade portion.

In some configurations, the first and second wires are welded to the body portion.

In another form, the present disclosure provides an electrical assembly that may include a first electrical component, a second electrical component, a third electrical component and a connector assembly. The first electrical component may include first and second wires. The second electrical component may include third and fourth wires. The third electrical component may include fifth and sixth wires. The connector assembly may include a first connector body, a second connector body configured to matingly receive the first connector body, and first and second terminal splitters received in at least one of the first and second connector bodies. Each of the first and second terminal splitters may include a body portion and a blade portion extending from the body portion. The body portion of the first terminal splitter may have the first and third wires electrically connected thereto. The blade portion of the first terminal splitter may have the fifth wire electrically connected thereto. The body portion of the second terminal splitter may have the second and fourth wires electrically connected thereto. The blade portion of the second terminal splitter may have the sixth wire electrically connected thereto.

In some configurations, a current amperage flowing through the first and second wires is equal to a sum of a first current amperage flowing through the third and fourth wires and a second current amperage flowing through the fifth and sixth wires.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
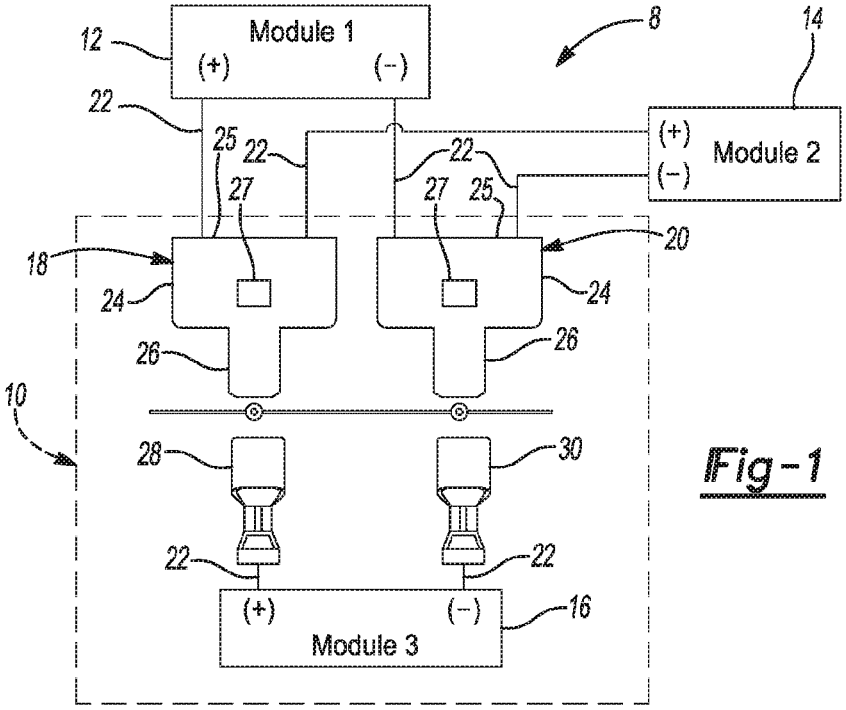
FIG. 1 is a schematic representation of an electrical assembly including a connector assembly having terminal splitters according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an electrical assembly 8 is provided that may include a connector assembly 10 that connects and provides electrical communication among first, second and third electrical components or modules 12, 14, 16. The connector assembly 10 may include first and second connector bodies 32, 34 (FIGS. 2 and 3) and first and second splitter terminals 18, 20.

Figure 6:
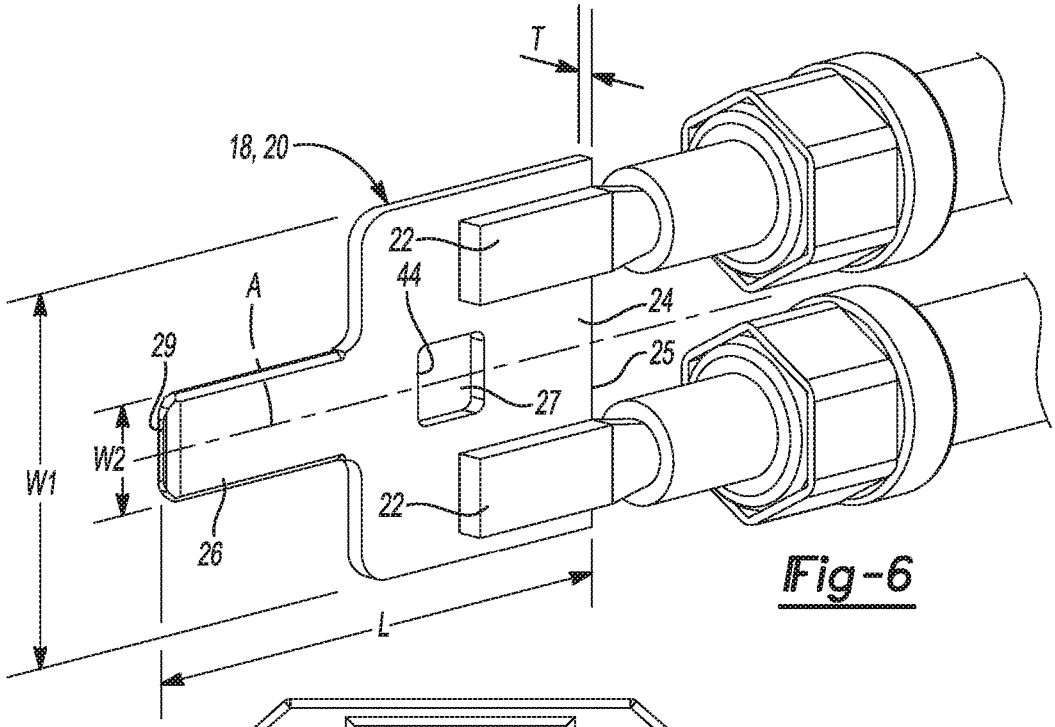
FIG. 6 is a perspective view of one of the terminal splitters having wires connected thereto.
Figure 7:
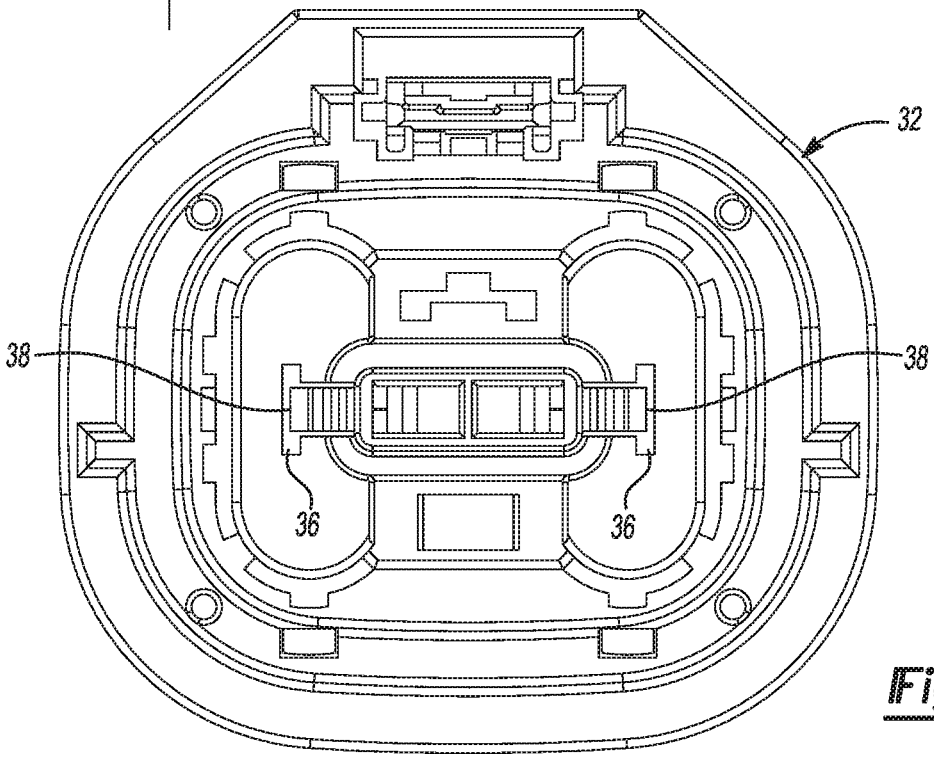
FIG. 7 is a plan view of the first connector body.

Each terminal 18, 20 is electrically coupled to a plurality of wires 22 (e.g., three wires 22). Each terminal 18, 20 may be a metallic, unitary body including a relatively large body portion 24 and a relatively smaller blade portion 26 extending from an end of the body portion 24, as shown in FIG. 1. As shown in FIG. 6, a width W1 of the body portion 24 is larger than a width W2 of the blade portion 24. The width W1 may be between about two and four times greater than the width W2, for example. The body portion 24 may include an aperture 27 extending therethrough. A longitudinal axis A (FIG. 6) of the blade portion 26 may extend through the aperture 27. While not shown in the figures, in some configurations, the aperture 27 may be an open-ended slot that extends through an edge 25 of the body 24 opposite the blade portion 26. The body portion 24 and the blade portion 26 may have a generally constant thickness T that is substantially smaller than the widths W1, W2 and a length L of the terminal 18, 20. The relatively large length and width of the body portion 24 allows for two wires 22 to be welded to each terminal 18, 20 and provides a heat sink for dissipating heat energy applied to the terminal 18, 20 during the welding process.

As shown in FIG. 6, the blade portion 26 may include a tapered distal end 29 (i.e., the distal end 29 is the end of the blade portion 26 that is farthest from the body portion 24). The tapered distal ends 29 reduce the force required to connect the first and second connector bodies 32, 34 by reducing the force required to insert the blade portions 26 into the slots 40 and into the receptacles 28, 30.

Figure 8:
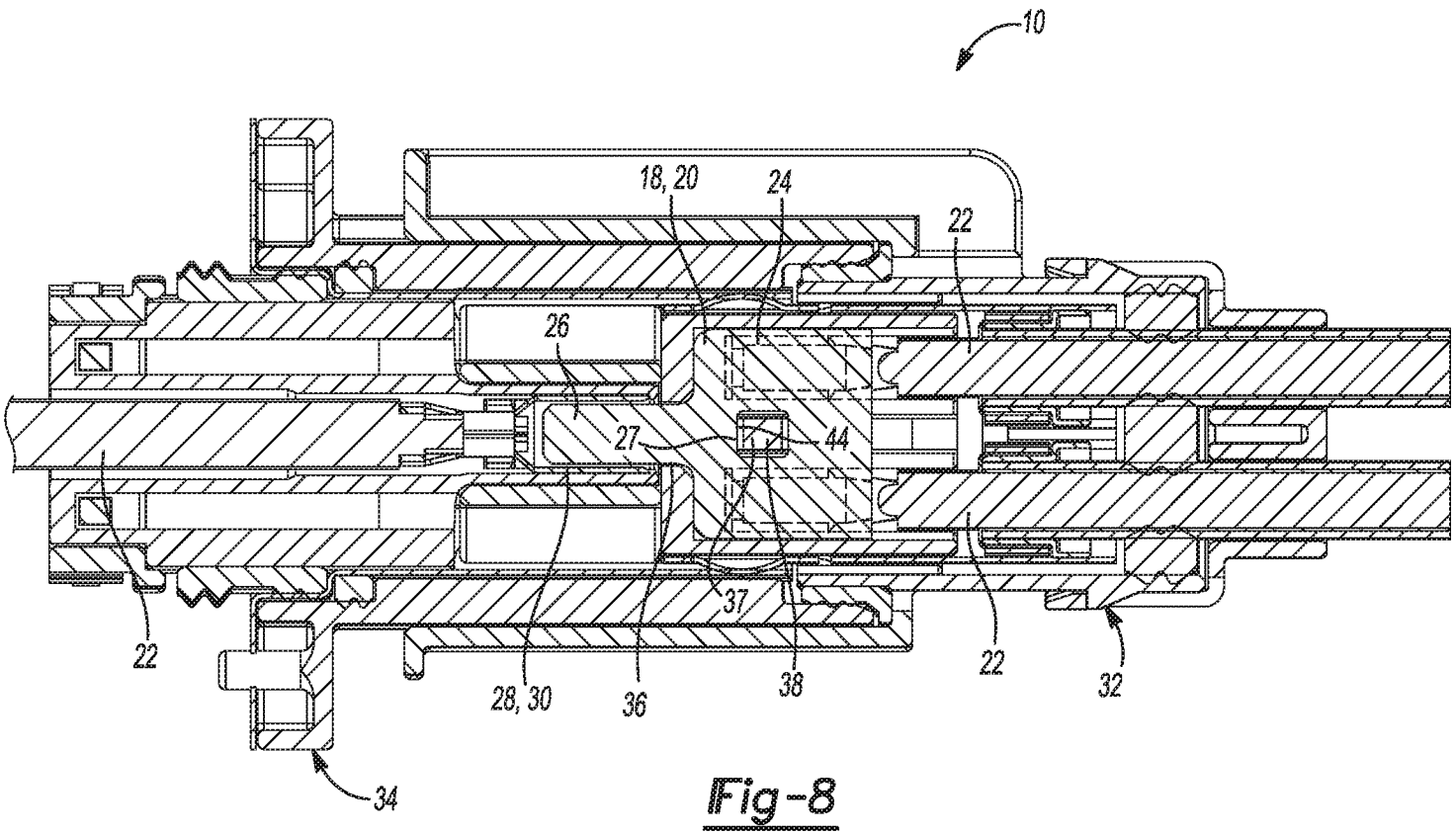
FIG. 8 is a cross-sectional view of the connector assembly.
Figure 9:
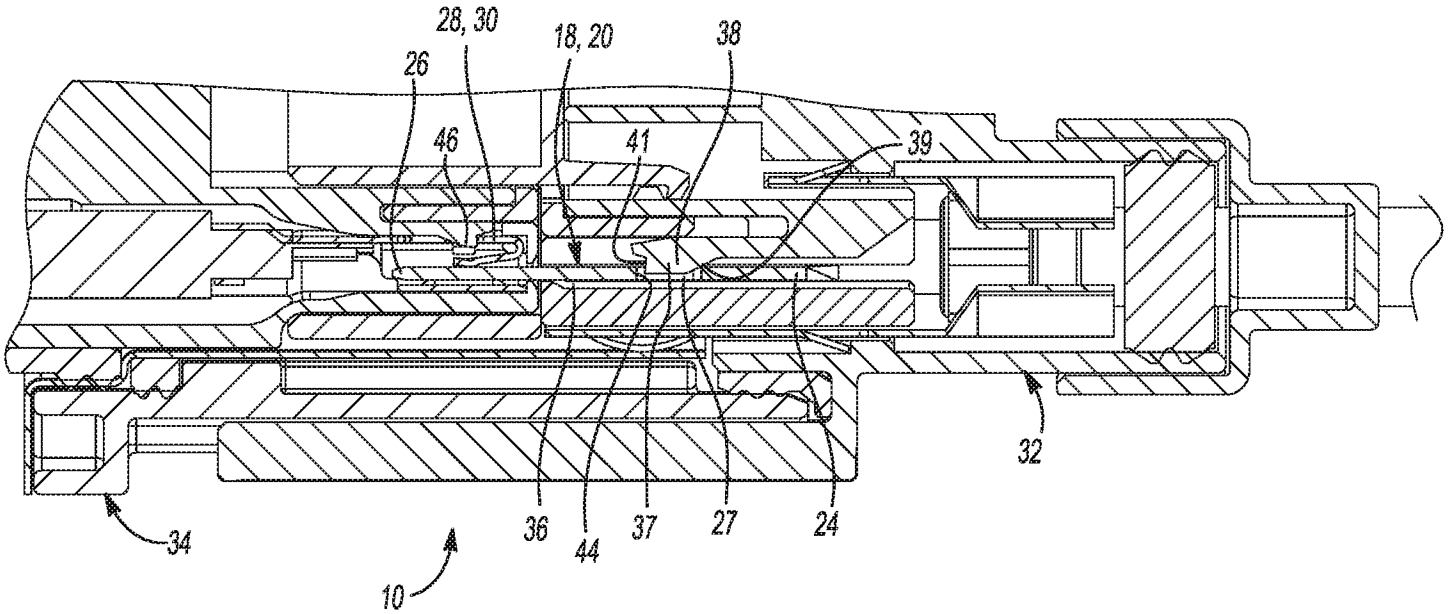
FIG. 9 is another cross-sectional view of the connector assembly.

As shown in FIGS. 1 and 6, one wire 22 from each of the first and second modules 12, 14 may be welded or otherwise electrically connected to the body portion 24 of the first terminal 18, and another wire 22 from each of the first and second modules 12, 14 may be welded, soldered and/or otherwise electrically connected to the body portion 24 of the first terminal 20. One wire 22 of the third module 16 may be welded, soldered and/or otherwise electrically connected to a first female receptacle 28, and another wire 22 of the third module 16 may be welded, soldered and/or otherwise electrically connected to a second female receptacle 30. As shown in FIGS. 1, 8 and 9, the first female receptacle 28 may receive and contact the blade portion 26 of the first terminal 18, and the second female receptacle 30 may receive and contact the blade portion 26 of the second terminal 20. In this manner, the terminals 18, 20 facilitate electrical current flow among the wires 22 of the first, second and third modules 12, 14, 16. That is, each terminal 18, 20 facilitates electrical current flow among a wire 22 from each of the first, second and third modules 12, 14, 16.

In the exemplary electrical assembly 8 shown in FIG. 1, electrical current may flow through the wires 22 and the connector assembly 10 from the first module 12 to the second and third modules 14, 16. In some configurations, the current amperage flowing through the wires 22 connected to the first module 12 may be equal to a sum (X+Y) of a first current amperage (X) flowing through the wires 22 connected to the second module 14 and a second current amperage (Y) flowing through the wires 22 connected to the third module 16.

Figure 2:
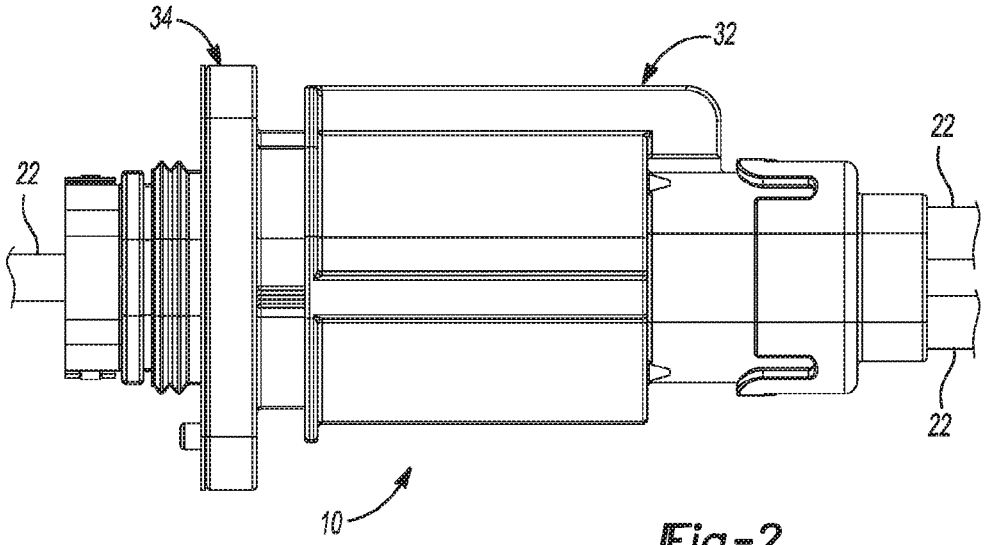
FIG. 2 is a side view of the connector assembly.
Figure 3:
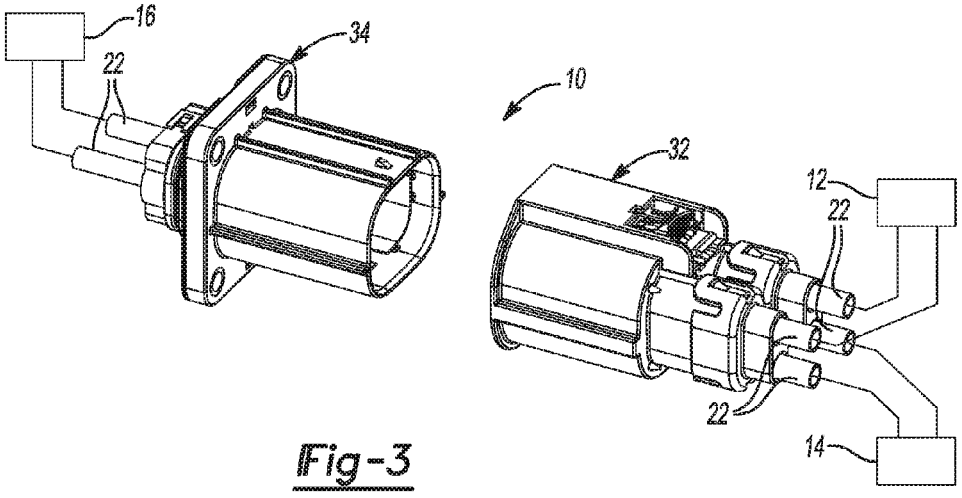
FIG. 3 is a partially exploded perspective view of the connector assembly with connector bodies connected to respective electrical components (shown schematically)
Figure 4:
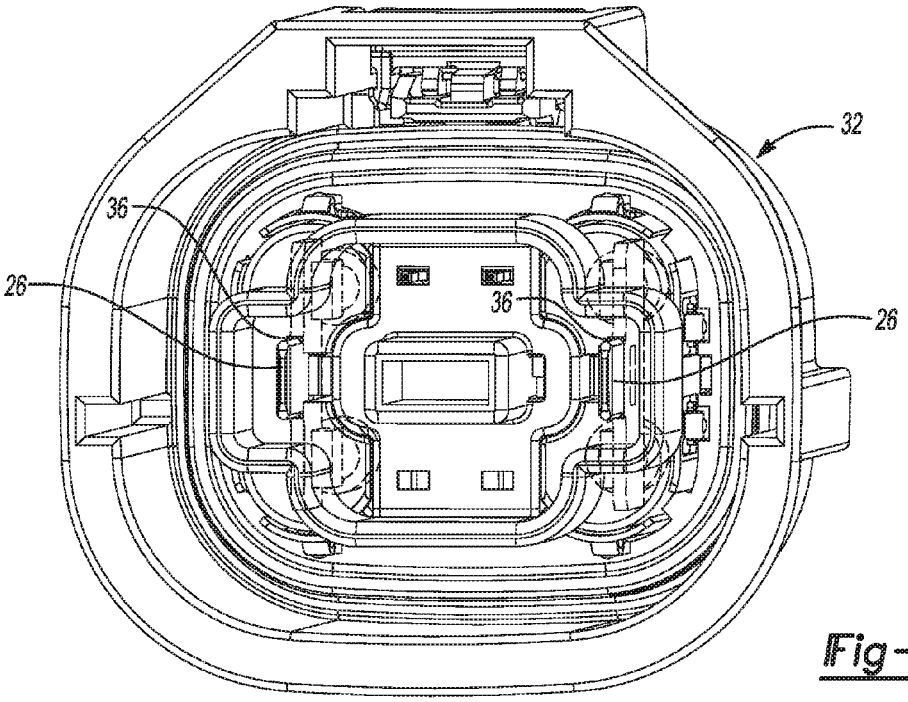
FIG. 4 is a perspective view of a first connector body of the connector assembly with the terminal splitters received therein.
Figure 5:
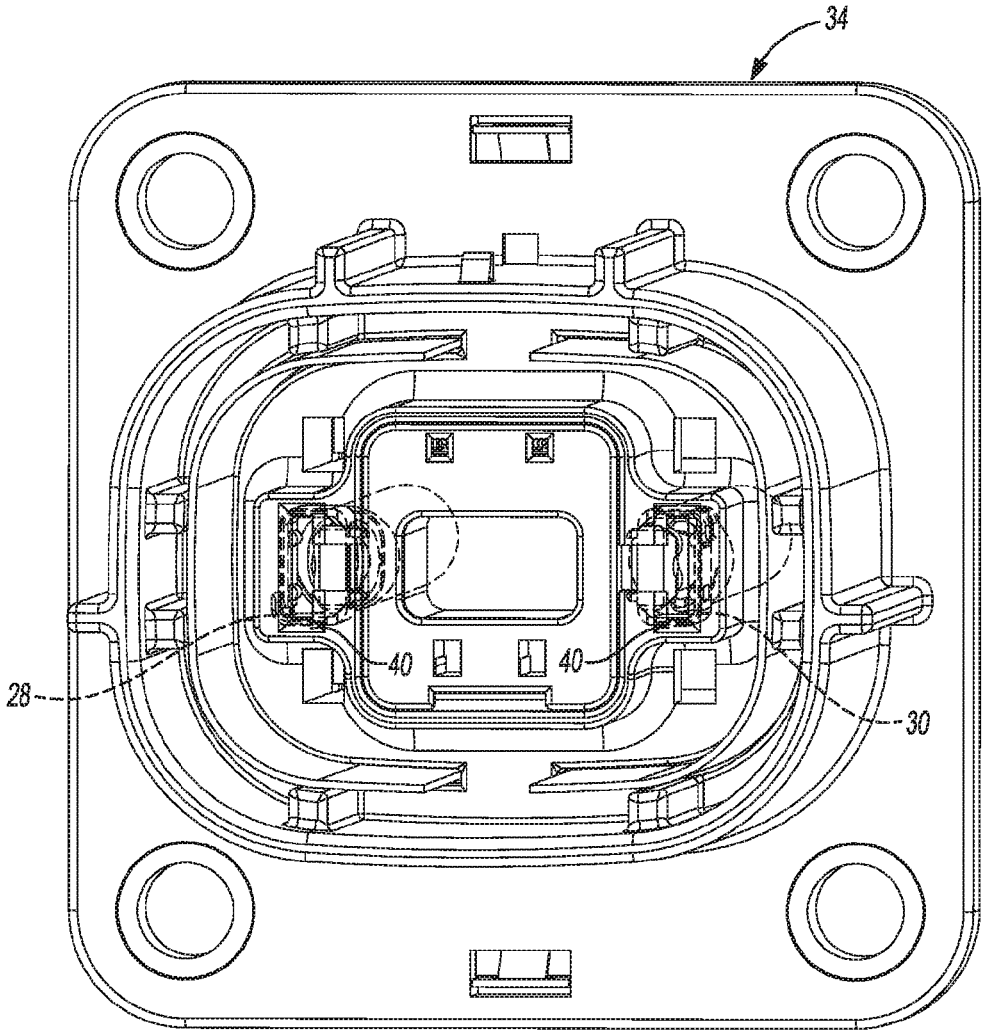
FIG. 5 is a perspective view of a second connector body of the connector assembly.

As shown in FIGS. 2 and 3, the connector assembly 10 may include a first connector body 32 and a second connector body 34. The first and second connector bodies 32, 34 may engage each other by a snap fit, for example. As shown in FIG. 9, the body portions 24 of the terminals 18, 20 may be received in slots 36 in the first connector body 32, and the blade portions 26 of the terminals 18, 20 may protrude out of the slots 36.

Figure 10:
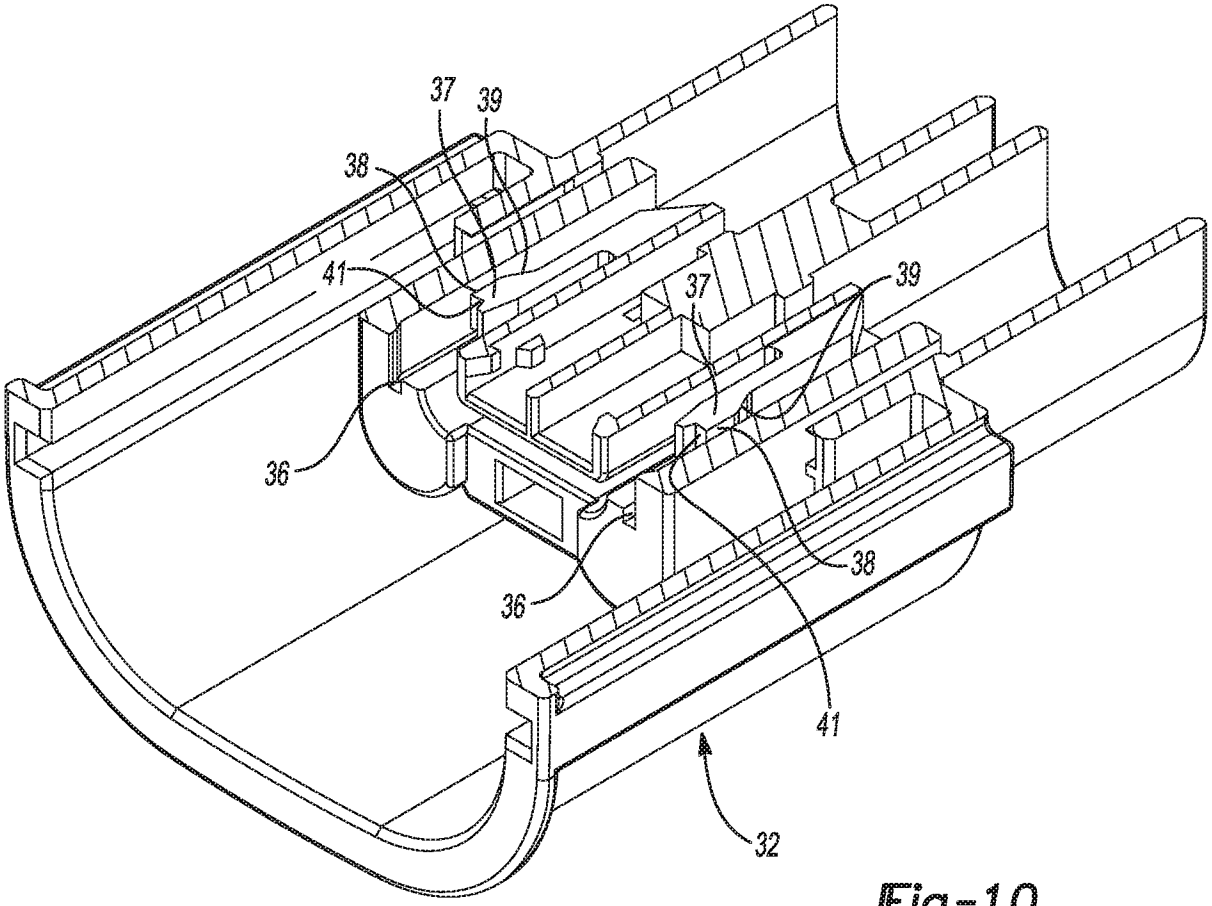
FIG. 10 is a perspective cross-sectional view of the first connector body.

The first connector body 32 may include flexible tabs 38 (FIGS. 9 and 10) that may snap into the apertures 27 in the terminals 18, 20 to retain the terminals 18, 20 within the first connector body 32. As shown in FIGS. 9 and 10, each of the tabs 38 may include a barbed protrusion 37 including a ramped surface 39 and a stop surface 41. The ramped surfaces 39 are disposed at a non-perpendicular angle relative to longitudinal axes A (FIG. 6) of the blade portions 26, so that the terminals 18, 20 can deflect the tabs 38 as the terminals 18, 20 are inserted into the slots 36. When the protrusion 37 is aligned with the aperture 27 in the terminal 18, 20, the tab 38 may snap back to its nominal position such that the protrusion 37 is received in the aperture 27, as shown in FIGS. 8 and 9. With the protrusion 37 received in the aperture 27, interference between the stop surface 41 of the protrusion 37 and a lock surface 44 defining the aperture 27 may restrict or prevent the terminal 18, 20 from being removed from the slot 36. The lock surface 44 may be a generally flat surface that is substantially perpendicular to the longitudinal axis A of the blade portion 26.

The first and second receptacles 28, 30 are received in the second connector body 34. When the first and second connector bodies 32, 34 are mated together (as shown in FIGS. 2, 8 and 9), the blade portions 26 of the terminals 18, 20 may extend through slots 40 in the second connector body 34 and into the receptacles 28, 30. The tapered distal ends 29 of the blade portions 26 facilitate easy insertion into the receptacles 28, 30. When the blade portions 26 of the terminals 18, 20 are received within the corresponding receptacles 28, 30, the blade portions 26 are in contact with the receptacles 28, 30, thereby electrically connecting the terminals 18, 20 with the receptacles 28, 30, respectively. As shown in FIG. 9, the receptacles 28, 30 may engage barbed tabs 46 of the second connector body 34. The tabs 46 may be constructed similarly to the tabs 38 and may allow insertion of the receptacles 28, 30 into the second connector body 34 while restricting or preventing removal of the receptacles 28, 30 from the second connector body 34.

The structure of the connector assembly 10 described above provides several advantages over conventional systems. For example, the connector assembly 10, and particularly the terminals 18, 20, enable the modules 12, 14, 16 to be connected for current flow therebetween in the manner described above using only a single connector assembly with only two connector bodies to be connected together. The construction of the connector bodies 32, 34 and the terminals 18, 20 allows for a small insertion force to connect the connector bodies 32, 34 together.

Furthermore, use of the connector assembly 10 reduces the number of wires 22 that are necessary to interconnect the modules 12, 14, 16 in the manner described above. In prior-art systems, the first module 12 would need to be connected to four wires 22, i.e., two wires extending from the first module 12 for connection to two wires extending from the second module 14 to facilitate communication between the first and second modules 12, 14; and two more wires extending from the first module 12 for connection to two wires extending from the third module 16 to facilitate communication between the first and third modules 12, 16. Therefore, the assembly 8 of the present disclosure may only include six wires 22 (two per module 12, 14, 16) instead of eight wires, as would be necessary for some prior-art systems. Some prior-art systems may also require multiple connector assemblies or a single connector assembly with four terminals that must be inserted into four receptacles. Inserting four terminals into four receptacles may require a relatively large amount of force. By contrast, the terminals 18, 20 of the present disclosure reduce the insertion force by only inserting two terminals 18, 20 into two receptacles 28, 30, while still interconnecting the three modules 12, 14, 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly comprising:

a first connector body;

a second connector body matingly engaging the first connector body; and a terminal splitter received in the first and second connector bodies, the terminal splitter including:

a body portion having first and second wires welded thereto, and an aperture extending therethrough; and a blade portion extending from the body portion, having a tapered distal end, and having a third wire connected thereto, the third wire including a female receptacle that receives the blade portion, wherein a longitudinal axis of the blade portion extends through the aperture, wherein the aperture is defined by a surface configured to interfere with a stop surface, the surface being a flat surface extending perpendicular to the longitudinal axis of the blade portion, wherein the body portion and the blade portion cooperate to form a flat unitary body, and wherein a width of the body portion is at least two times greater than a width of the blade portion.

2. The connector assembly of claim 1, wherein the aperture at least partially receives a flexible tab of the first connector body.

3. The connector assembly of claim 2, wherein the flexible tab includes a ramped surface and a stop surface, wherein a portion of the ramped surface and a portion of the stop surface are received in the aperture, and wherein the stop surface interferes with the surface defining the aperture to restrict removal of the terminal splitter from the first and second connector bodies.

4. The connector assembly of claim 3, wherein the terminal splitter is a metallic member.

5. An electrical assembly comprising:

a first electrical component including first and second wires;

a second electrical component including third and fourth wires;

a third electrical component including fifth and sixth wires; and a connector assembly including a first connector body, a second connector body configured to matingly engage the first connector body, and first and second terminal splitters received in at least one of the first and second connector bodies, each of the first and second terminal splitters including a body portion and a blade portion extending from the body portion, the body portion of the first terminal splitter having the first and third wires electrically connected thereto, the blade portion of the first terminal splitter having the fifth wire electrically connected thereto, the body portion of the second terminal splitter having the second and fourth wires electrically connected thereto, the blade portion of the second terminal splitter having the sixth wire electrically connected thereto, wherein the body portion of the first terminal splitter and the blade portion of the first terminal splitter cooperate to form a first flat unitary body, wherein the body portion of the second terminal splitter and the blade portion of the second terminal splitter cooperate to form a second flat unitary body, wherein a width of the body portion of the first terminal splitter is at least two times greater than a width of the blade portion of the first terminal splitter, and wherein a width of the body portion of the second terminal splitter is at least two times greater than a width of the blade portion of the second terminal splitter.

6. The electrical assembly of claim 5, wherein a current amperage flowing through the first and second wires is equal to a sum of a first current amperage flowing through the third and fourth wires and a second current amperage flowing through the fifth and sixth wires.

7. The electrical assembly of claim 5, wherein the body portion includes an aperture that at least partially receives a flexible tab of the first connector body.

8. The electrical assembly of claim 7, wherein the flexible tab includes a ramped surface and a stop surface, wherein a portion of the ramped surface and a portion of the stop surface are received in the aperture, and wherein the stop surface interferes with a surface defining the aperture to restrict removal of the terminal splitters from the first and second connector bodies.

9. The electrical assembly of claim 7, wherein a longitudinal axis of the blade portion extends through the aperture.

10. The electrical assembly of claim 9, wherein the surface of the aperture with which the stop surface interferes is a flat surface extending perpendicular to the longitudinal axis of the blade portion.

11. The electrical assembly of claim 5, wherein the terminal splitters are metallic members.

12. The electrical assembly of claim 5, wherein the blade portion includes a tapered distal end.

13. The electrical assembly of claim 5, wherein the third wire includes a female receptacle that receives the blade portion.

* * * * *